US005857764A

United States Patent [19]

Tabata et al.

[11] Patent Number: 5,857,764

[45] Date of Patent: Jan. 12, 1999

[54] VEHICLE LIGHT BULB

[75] Inventors: Hajime Tabata; Toru Hasegawa, both of Saitama, Japan

[73] Assignee: Honda Giken Kogyo Kabushiki Kaisha, Tokyo, Japan

[21] Appl. No.: 870,634

[22] Filed: Jun. 6, 1997

[30] Foreign Application Priority Data

Jun. 6, 1996 [JP] Japan ..... 8-144725
Feb. 17, 1997 [JP] Japan ..... 9-032383

[51] Int. Cl.[6] ..... H01K 1/26

[52] U.S. Cl. ..... 362/214; 362/211; 362/61; 313/112; 313/115

[58] Field of Search ..... 362/211, 214, 362/61; 313/112, 115

[56] References Cited

U.S. PATENT DOCUMENTS 3,249,789 5/1966 Preschel et al. .
3,310,702 3/1967 Falge .
4,523,262 6/1985 Shinkai ..... 362/214
4,686,410 8/1987 Jacrot .
5,111,105 5/1992 Yamamoto ..... 313/115

FOREIGN PATENT DOCUMENTS 33079 6/1979 Finland ..... 313/115
363721 9/1962 Germany ..... 313/115
64-2356U 1/1989 Japan .
U64-2356 1/1989 Japan .

*Primary Examiner*—Thomas M. Sember
*Attorney, Agent, or Firm*—Birch, Stewart, Kolasch & Birch, LLP

[57] ABSTRACT

To prolong the life of a vehicle light bulb by securing the legs of the dipped beam filament by forming a hole in cupped shield, fixing one leg directly to common lead by passing this leg through the hole, and fixing the other leg directly to lead. If the shield vibrates as shown by circled arrows 2 and 2, this vibration is not transmitted to the dipped beam filament. Accordingly, the life of dipped beam filament can be further prolonged.

10 Claims, 12 Drawing Sheets

"CONVENTIONAL ART"

"CONVENTIONAL ART"

"CONVENTIONAL ART"

"CONVENTIONAL ART"

VEHICLE LIGHT BULB

BACKGROUND OF THE INVENTION

1. Field of the Invention

The present invention relates to a vibration resistant vehicle light bulb applied to automobiles and other types of vehicles.

2. Description of Background Art

FIG. 18 illustrates a side view of a conventional automobile light bulb referred to as "H4," wherein the automobile light bulb 100 comprises a glass bulb 101, a cap 102 that seals off the opening of the glass bulb 101, a common lead 103, a cupped shield 104 secured by welding to the top of this common lead 103, a dipped beam filament 105 disposed along this shield 104, a lead 106 for the use thereof, a main beam filament 107 disposed below shield 104, a lead 108 for the use thereof, and a reinforcing bridge 109, a halogen gas is sealed inside glass bulb 101. One leg 105*a* of the dipped beam filament 105 is affixed to the shield 104, and the other leg 105*b* is affixed to lead 106.

The three leads 103, 106 and 108 project from cap 102 in the form of cantilever beams, so that these leads 103, 106 and 108 vibrate more toward the tip (the top end) when they are subjected to vibration. Shield 104, which is even further away from cap 102, has a large vibration amplitude, and unless shield 104 is securely welded to common lead 103, the vibration of shield 104 will be delayed with respect to that of the common lead 103 so that when the vibration amplitude increases, the stress in the dipped beam filament 105 disposed along it will increase and its life will become shortened as a result. Unexamined Published Japanese Utility Model Application (JP-A-U) No. S64-2356 (1989) was therefore proposed to combat this problem. The proposed light bulb is described as follows.

FIG. 19 shows a side view of a conventional vibration resistant automobile light bulb, wherein the automobile light bulb 110 comprises a glass bulb 111, a cap 112 that seals off the opening of the glass bulb 111, a common lead 113 whose tip reaches the neck part 111*a* of the glass bulb 111, a cupped shield 114 that is secured by welding to the mid-part of this common lead 113, a dipped beam filament 115 disposed along this shield 114, a lead 116 for the use thereof, a main beam filament 117 disposed below the shield 114, a lead 118 for the use thereof, and a reinforcing bridge 119, a halogen gas being sealed inside glass bulb 111. One leg 115*a* of dipped beam filament 115 is affixed to shield 114, and the other leg 115*b* is affixed to lead 116.

Since the common lead 113 is a beam supported at both ends when its tip is fixed to neck part 111*a*, its flexion is markedly less than that of a cantilever beam, and its vibration amplitude is also small. The life of dipped beam filament 115 is thus greatly prolonged.

Thus, light bulb 110, which comprises lead 113 linked to glass bulb 111, is called a vibration-resistant automobile light bulb.

FIG. 20 illustrates a cross section taken along line 20—20 in FIG. 19, wherein a cupped shield 114 is affixed by projection welding to common lead 113. More specifically, a small projection is formed from the metal shield 114 to the right of the figure, this projection is brought into contact with common lead 113, and an electrical current is made to flow, causing the electrical current to concentrate at the projection which is welded by the resulting Joule heat. FIG. 21 is a view along arrow 21 in FIG. 19, showing how one leg 115*a* of dipped beam filament 115 is fixed to cupped shield 114 and the other leg 115*b* is fixed to lead 116. As this figure illustrates, dipped beam filament 115 is formed from a coil spring of heating wire, pulled out by a distance L in a tangential direction at the end part 115*c* of the coil, and is then bent up to make a conventional leg structure.

In FIG. 20, there is a danger that the shield 114 will vibrate as shown by the circled arrows 1 centered on the welding point 121. If this happens, it would be inconvenient because dipped beam filament 115, which is attached at one end to lead 116 and at the other end to shield 114 will also vibrate.

Also, in FIG. 21, because leg 115*a* is separated by a distance L from the center of the glass bulb 111, it is also inconvenient in that leg 115*a* vibrates along with the vibration of shield 114.

SUMMARY AND OBJECTS OF THE INVENTION

It is therefore an object of the present invention to prolong the life of light bulbs applied to vehicles such as automobiles by improving the method for fixing the legs of the dipped beam filament.

In order to solve the above mentioned problems, one leg of the dipped beam filament is fixed directly to the common lead.

Since one leg of the dipped beam filament is fixed directly to the common lead, which is not liable to vibrate, instead of to the shield which is likely to vibrate, vibration of the dipped beam filament can be suppressed and the life of the vehicle bulb can be further prolonged.

A hole is formed in the shield and one leg of the dipped beam filament is guided to the common lead by passing it through this hole.

Since this only involves forming a hole in the type of shield that is currently available, there is no danger of this step resulting in increased costs.

A light-shielding film is applied to the tip of the glass bulb, the shield is cut away at the portion shielded by thin shielding film, and one leg of the dipped beam filament is guided to said common lead through this cutaway portion.

This provides for a shield that is reduced in size by making skillful use of a light-shielding film, whereby it is possible both to economize on the materials used for the shield and to prolong the life of the vehicle light bulb.

The shield comprises a cut part and a tongue part that is fixed extending from the cup so as to pass through roughly the center of the bulb, and in that its tongue part is fixed to one leg of the dipped beam filament at roughly the central position of the glass bulb.

When the shield vibrates, since one leg of the dipped beam filament is fixed at the center of swaying, the vibration amplitude of the dipped beam filament can be suppressed and the life of the vehicle light bulb can be further prolonged.

The dipped beam filament consists of a coil part comprising a conductor formed in the shape of a coil spring, one leg that extends out in a straight line from one end of the coil part along a line that is tangential to the coils of this coil part, and another leg that extends out in a straight line from the other end of the coil part along a line that is tangential to the coils of this coil part and is perpendicular to this one leg, and in that the one leg is fixed to the shield and the other leg is fixed to the dipped beam filament lead.

Even if the one leg vibrates due to vibration of the shield, this vibration can be absorbed by the coil part so that the life of the vehicle light bulb can be further prolonged.

The shield is provided with a tongue part for fixing the other leg. Since the tongue part is provided, it is easy to fix the other leg of the dipped beam filament to the shield.

The dipped beam filament consists of a coil part and includes a conductor formed in the shape of a coil spring, one leg that extends out in a straight line from one end of the coil part along a line that is tangential to the coils of this coil part, and another leg that extends out in a straight line from the other end of the coil part along a line that is tangential to the coils of this coil part and is perpendicular to this one leg, and in that the one leg is fixed to the common lead and the other leg is fixed to the dipped beam filament lead.

Even if the one leg vibrates due to vibration of the common lead, this vibration can be absorbed by the coil part and the life of the vehicle light bulb can be further prolonged.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 11(*b*) illustrates vibration of a shield in direction X1 with a leg vibrating with a first amplitude in direction X1;

FIG. 11(*c*) illustrates the shield vibrating in direction X2 with the leg vibrating with a first amplitude in direction X2;

FIG. 11(*d*) illustrates vibration of a shield in direction Y1 with a leg vibrating with a second amplitude in direction Y1;

FIG. 11(*e*) illustrates the shield vibrating in direction Y2 with the leg vibrating with a second amplitude in direction Y2;

FIG. 17(*b*) illustrates vibration of the leg when the shield vibrates in a first direction;

FIG. 17(*c*) illustrates vibration of the leg when the shield vibrates in a second direction;

DETAILED DESCRIPTION OF THE PREFERRED EMBODIMENTS

Embodiments of the present invention are described below based on FIGS. 1–17.

Figure 1:
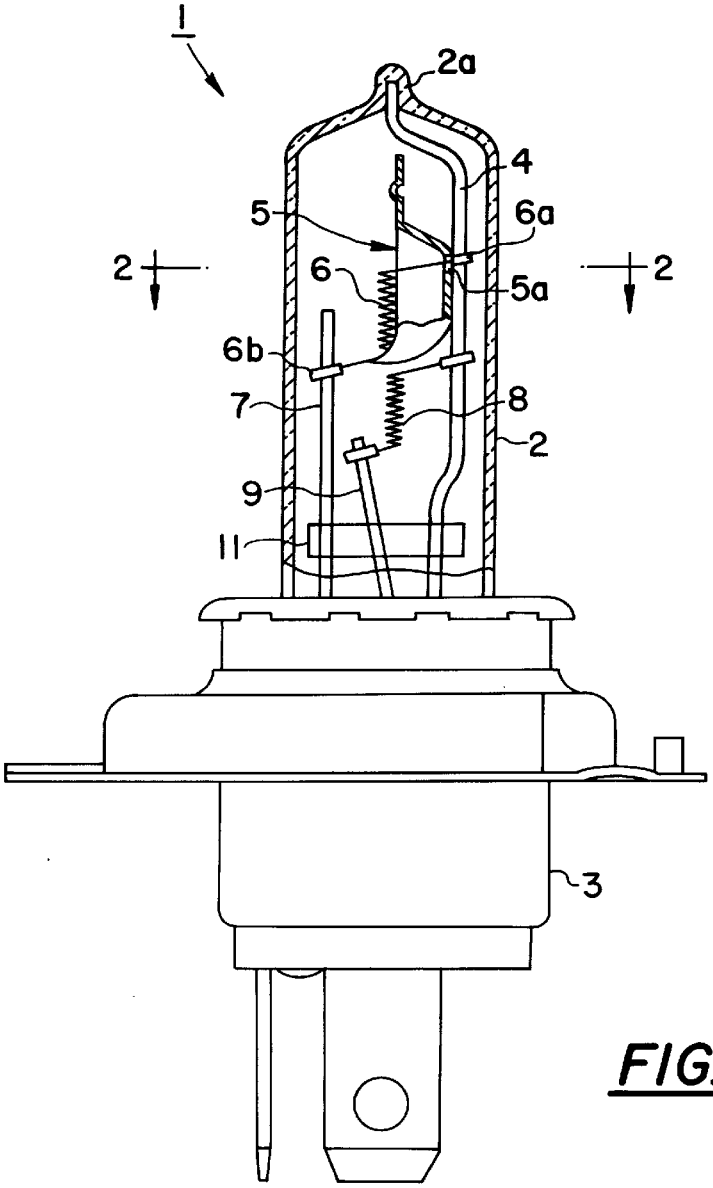
FIG. 1 is a side view of an automobile light bulb of a first embodiment of the present invention.

FIG. 1 shows a side view of an automobile light bulb according to a first embodiment of the present invention, wherein the automobile light bulb 1 is a vehicle light bulb including a glass bulb 2, a cap 3 that seals off the opening of glass bulb 2, a common lead 4 whose tip reaches the neck part 2*a* of glass bulb 2, a cupped shield 5 secured by welding midway along this common lead 4, a dipped beam filament 6 disposed along this shield 5, a lead 7 for the use thereof and a main beam filament 8 disposed below shield 5. A lead 9 is provided together with a reinforcing bridge 11. Halogen gas is sealed inside the glass bulb 2. One leg 6*a* of dipped beam filament 6 is affixed to lead 4, and the other leg 6*b* is affixed to the lead 7.

Note that when main beam filament 8 is selected, the main beam filament 8 is illuminated by the following circuit: lead 9 to the main beam filament 8 to the common lead 4 (or the reverse thereof). Also, when dipped beam filament 6 is selected, dipped beam filament 6 is illuminated by the following circuit: lead 7 to dipped beam filament 6 to common lead 4 (or the reverse thereof).

Figure 2:
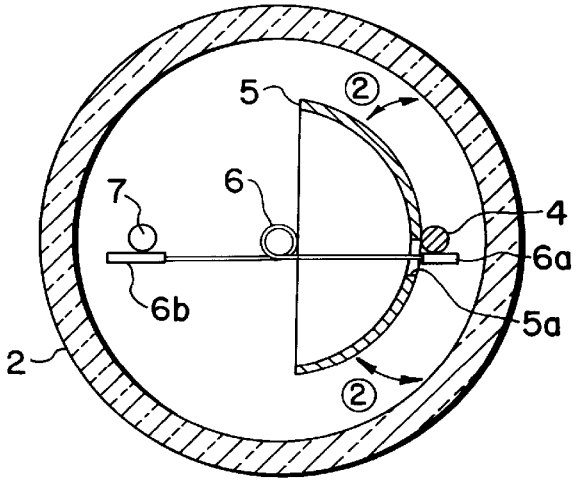
FIG. 2 is a cross section taken along line 2—2 in FIG. 1.

FIG. 2 illustrates a cross section taken along line 2—2 in FIG. 1, wherein the dipped beam filament 6 is attached. The dipped beam filament 6 is attached by forming a hole 5*a* in the cupped shield 5 and fixing one leg 6*a* directly to the common lead 4 by passing this leg 6*a* through the hole. In addition, the other leg 6*b* is fixed directly to lead 7.

Even supposing shield 5 vibrates as shown by the circled arrows 2 and 2, this vibration is not transmitted to the dipped beam filament 6. Accordingly, the life of the dipped beam filament 6 can be further prolonged.

Figure 3:
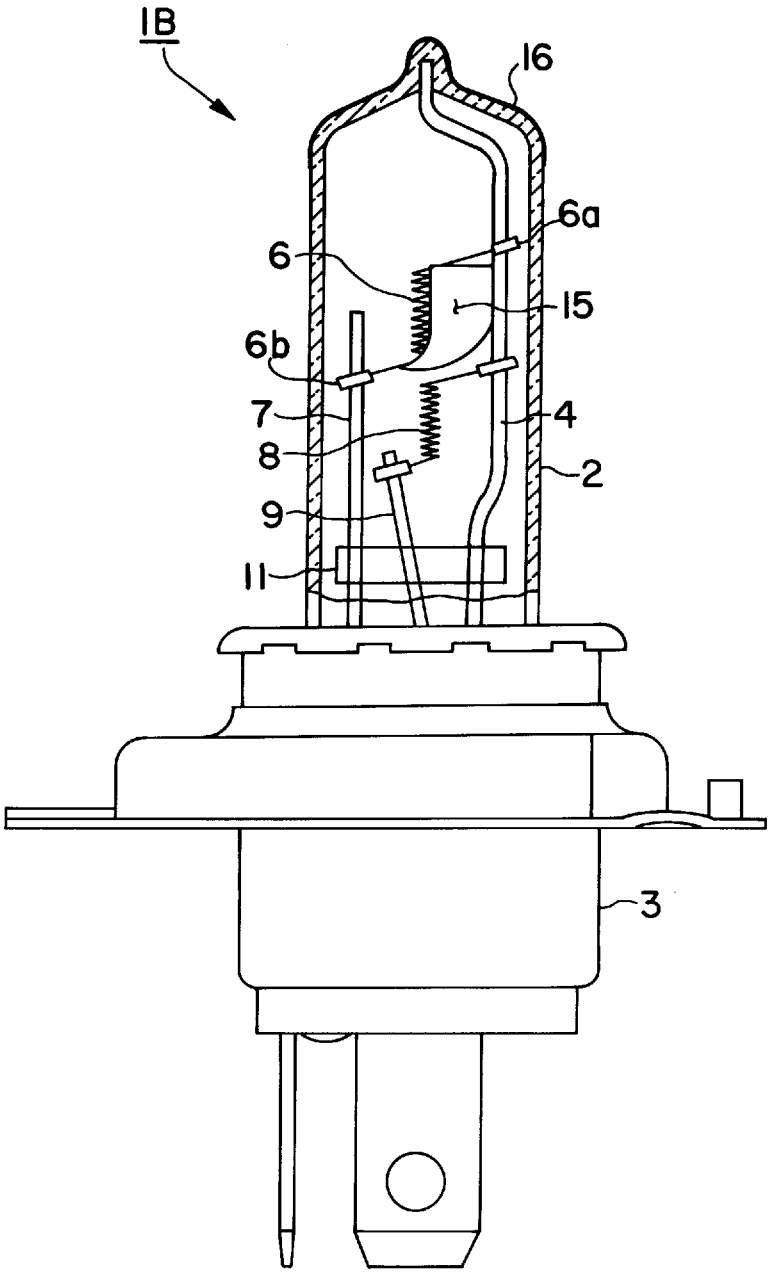
FIG. 3 is a side view of an automobile light bulb according to a second embodiment of the present invention.

FIG. 3 illustrates a side view of an automobile light bulb according to a second embodiment of the present invention, wherein, as in the first embodiment, an automobile light bulb 1B includes a glass bulb 2, a cap 3, a common lead 4 and a dipped beam filament 6. A lead 7 is provided together with a main beam filament 8, a lead 9 and a reinforcing bridge 11, along with a shield 15 and a light shielding film 16 that are specific to this embodiment.

Light-shielding film 16 is also employed in conventional automobile light bulbs, but the shape of the shield 15 is a specific feature.

Figure 4:
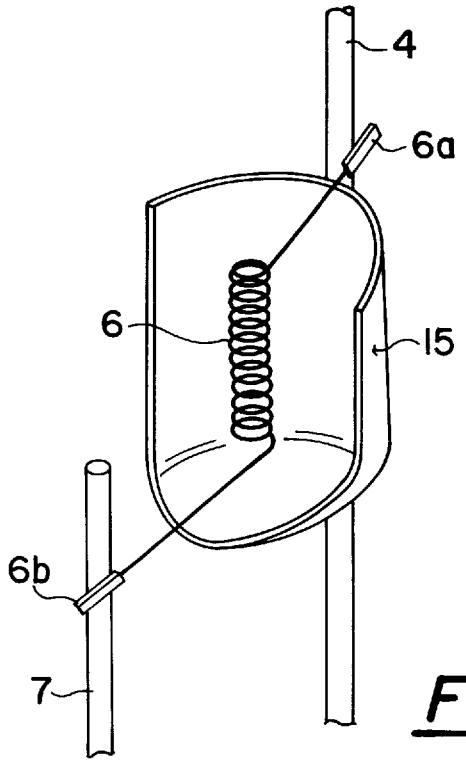
FIG. 4 is an oblique view of the salient parts of an automobile light bulb according to a second embodiment of the present invention.

FIG. 4 illustrates an oblique view of the salient parts of an automobile light bulb according to a second embodiment of the present invention wherein the shield 15 includes a half-cup shade with the top part cut away. One leg 6*a* of the dipped beam filament 6 is attached to the common lead 4 through this cutaway portion.

Since one leg 6*a* of the dipped beam filament 6 is fixed directly to the common lead 4 after passing over the top of shield 15 while the other leg 6*b* is fixed directly to lead 7, even supposing shield 15 vibrates, its effect does not extend to the dipped beam filament 6. Accordingly, the life of dipped beam filament 6 can be further prolonged.

Figure 5:
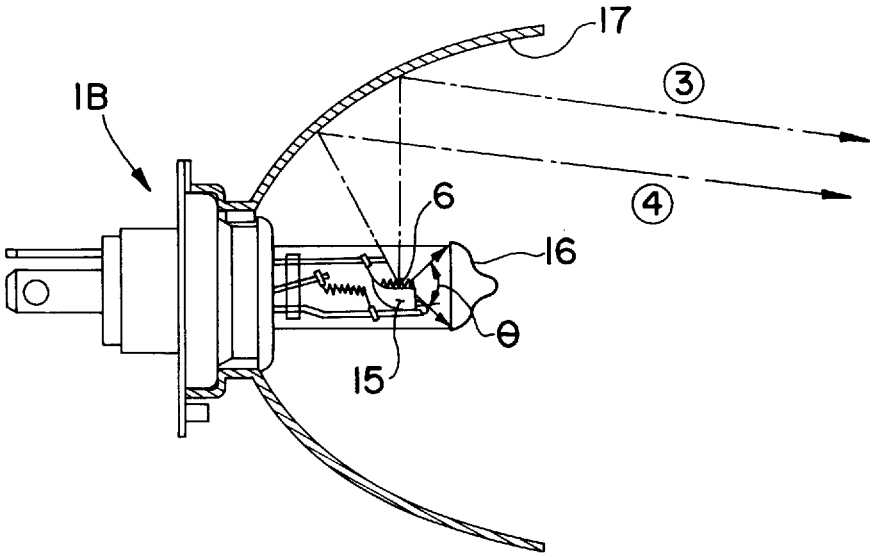
FIG. 5 is an illustration explaining the operation of an automobile light bulb according to a second embodiment of the present invention.

FIG. 5 is an illustration explaining the operation of an automobile light bulb according to a second embodiment of the present invention, which is a theoretical view for confirming the operation of shield 15 with the top part, to the right as illustrated in FIG. 5, being cut away.

Since the light emitted directly from dipped beam filament 6 is shielded by shield 15, the light projects to the top and to the right of FIG. 5, with very little of the light reaching towards the bottom of FIG. 5.

The light that reaches the right as illustrated in FIG. 5 directly, at an angle $\ominus$, proceeds no further because it is shielded by light-shielding film 16. On the other hand, the direct light projecting upwardly is reflected by the parabolic mirror 17 and then proceeds as shown by the circled arrows 3 and 4.

Figure 18:
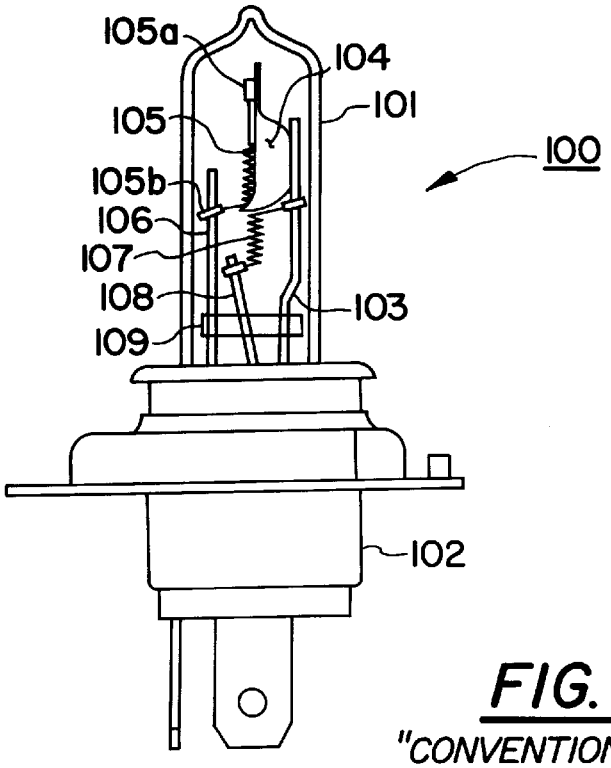
FIG. 18 is a side view of a conventional automobile light bulb.

Thus, despite the fact that the shield 15 is a half cup with a top part of the shield being cut away, its operation is in no way inferior to that of a full-cup shield, e.g. item 104 in FIG. 18.

Figure 6:
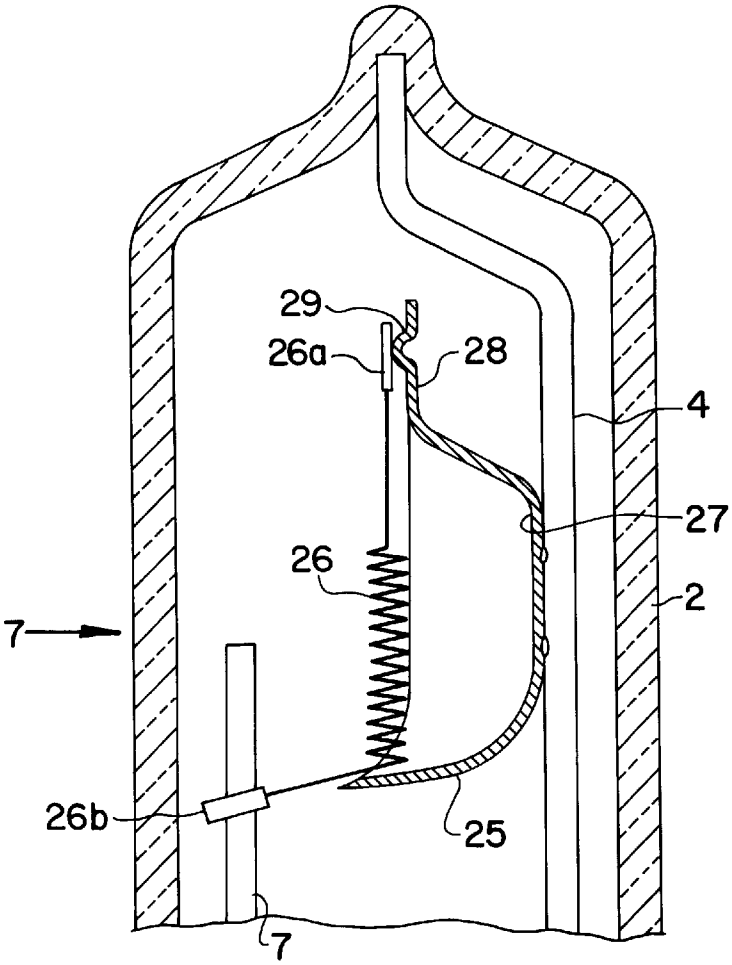
FIG. 6 is a side view of the salient parts of an automobile light bulb according to a third embodiment of the present invention.

FIG. 6 illustrates a side view of the salient parts of an automobile light bulb according to a third embodiment of the present invention. FIG. 6 is similar in appearance to the side view of a conventional automobile light bulb, and illustrates the relative positions of the glass bulb 2, common lead 4, shield 25, dipped beam filament 26, and lead 7.

As set forth in FIG. 6, shield 25 includes a cup part 27, a tongue part 28 that bulges out from the top edge, a protruding strip 29 formed midway along tongue part 28, and tongue part 28 is positioned more or less in the center of glass bulb 2.

Figure 7:
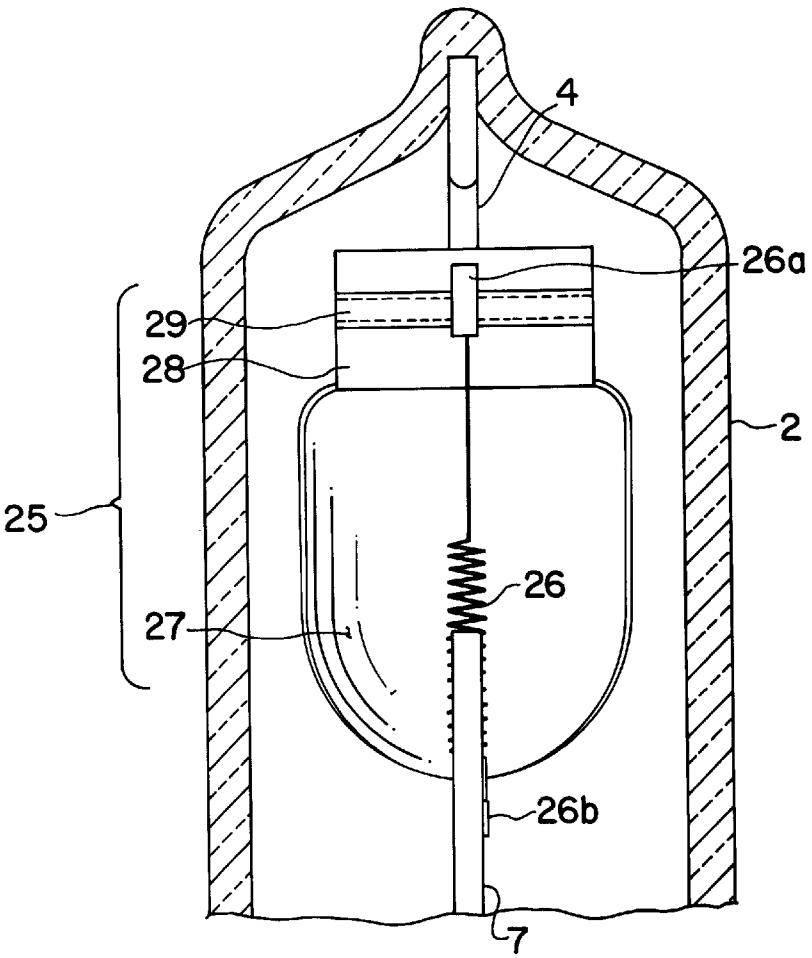
FIG. 7 is a view taken along arrow 7 in FIG. 6.

FIG. 7 illustrates a view along arrow 7 in FIG. 6, wherein protruding strip 29 formed on tongue part 28 is the part that is joined to one leg 26*a* of dipped beam filament 26. The important point illustrated in FIG. 7 is that one leg 26*a* of the dipped beam filament 26 is affixed to the center of tongue part 28 in the width direction, that is, more or less at the central position of glass bulb 2. Additionally, the upper coiled end part of dipped beam filament 26, which has a coil spring shape, is formed into an a coiled curved shape when viewed horizontally, and leg 26*a* is pulled out to above the center of winding. As a result, leg 26*a* can be fixed to the center of the tongue part 28 in the width direction.

Figure 8:
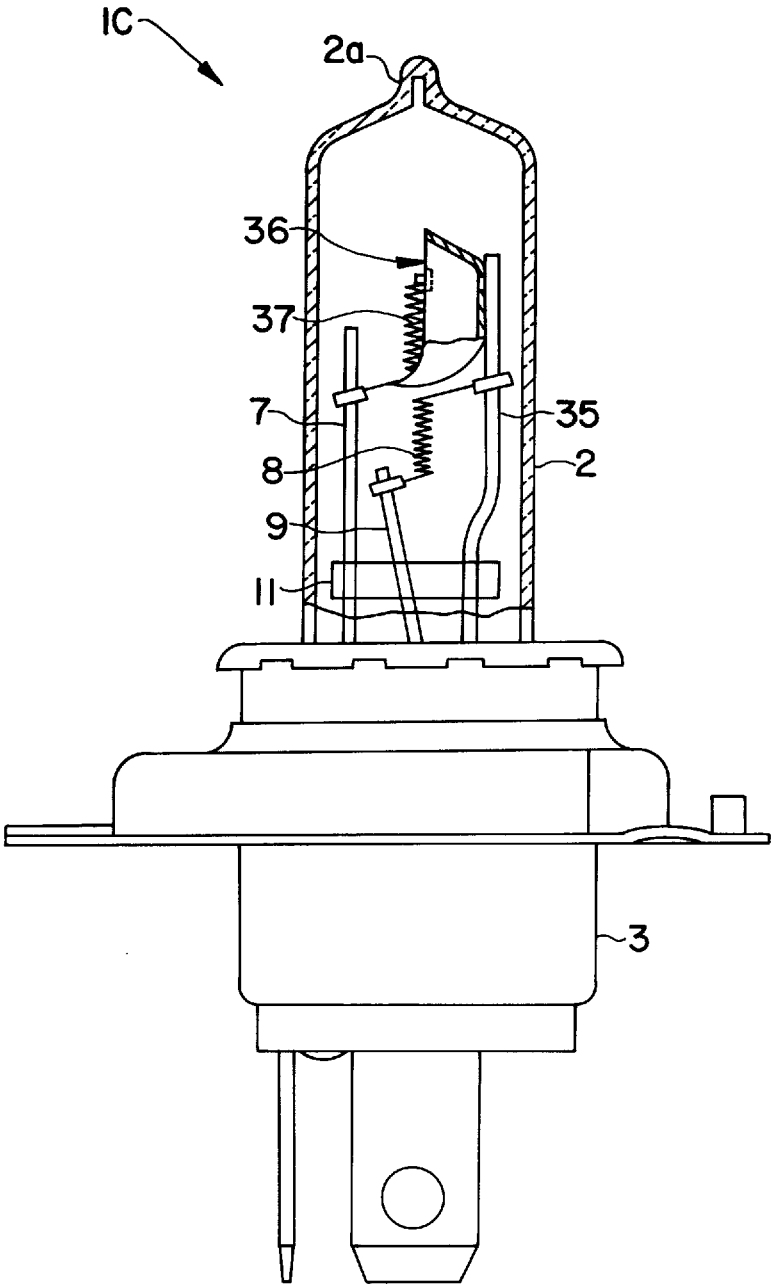
FIG. 8 is a side view of an automobile light bulb according to a fourth embodiment of the present invention.

Since one leg 26*a* of dipped beam filament 26 is fixed to the vibrational center when shield 25 vibrates, the vibration of dipped beam filament 26 can be suppressed, and the life of the automobile light bulb can be further prolonged. FIG. 8 illustrates a side view of an automobile light bulb according to a fourth embodiment of the present invention where, as in the first embodiment, automobile light bulb 1C includes a glass bulb 2, a cap 3, a lead 7 for the dipped beam filament, a main beam filament 8, a lead 9 for the use thereof, a reinforcing bridge 11, and a common lead 35, along with a shield 36 and the dipped beam filament 37 that are specific to this embodiment.

Like the common lead 103 used in the ordinary light bulb of FIG. 18, common lead 35 is a cantilever beam with a tip separated from the neck part 2*a* of the glass bulb 2. Note that the shield 36 and the dipped beam filament 37 are described in FIG. 9.

Figure 9:
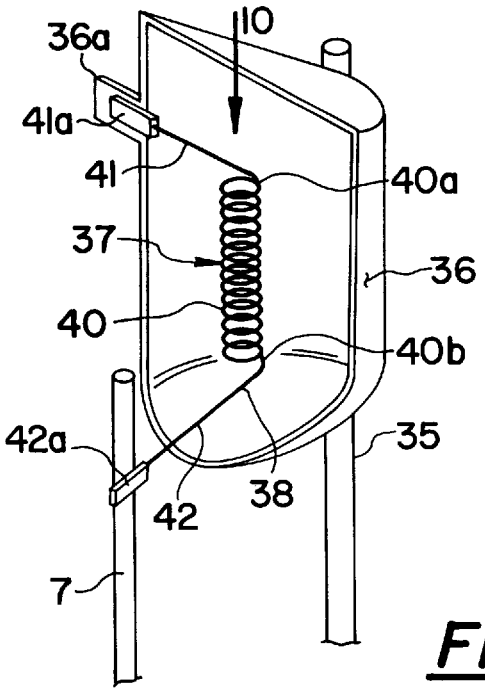
FIG. 9 is an oblique view showing the salient parts of an automobile light bulb of the fourth embodiment of the present invention.

FIG. 9 is an oblique view showing the salient parts of an automobile light bulb according to a fourth embodiment of the present invention, wherein the dipped beam filament 37 includes a coil part 40 made by forming a wire-shaped conductor 38 into a coil spring, one leg 41 extends out in a straight line from one coiled end part 40*a* of this coil part 40, and another leg 42 extending out in a straight line from the other coiled end part 40*b* of the coil part 40 at right angles to this one leg 41. The tip 41*a* of the one leg 41 is fixed to a tongue part 36*a* of shield 36, and the tip 42*a* of the other leg 42 is fixed to the lead 7 for the dipped beam filament.

Figure 10:
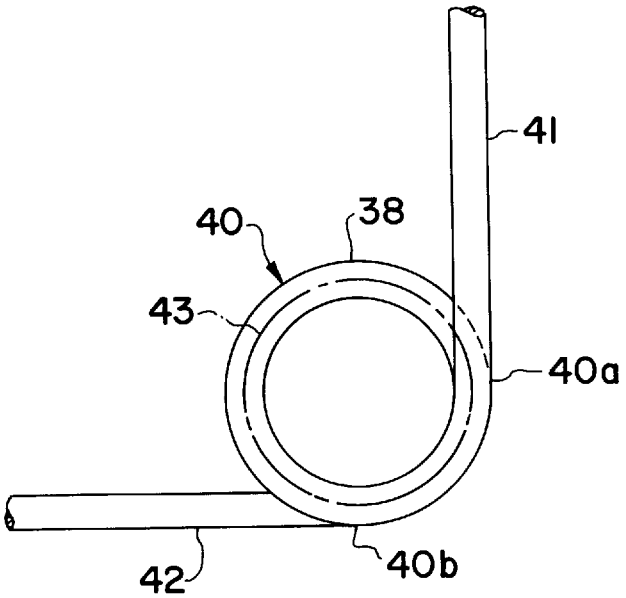
FIG. 10 is a view taken along arrow 10 in FIG. 9.
Figure 11A:
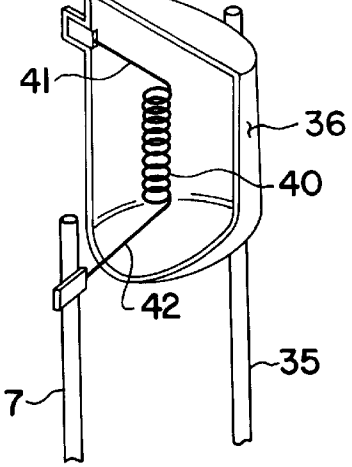
FIG. 11(*a*) is an illustration explaining the operation of an automobile light bulb according to the fourth embodiment of the present invention.
Figure 11B:
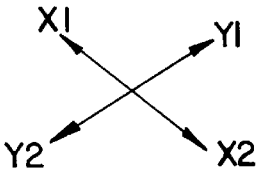
Figure 11B:
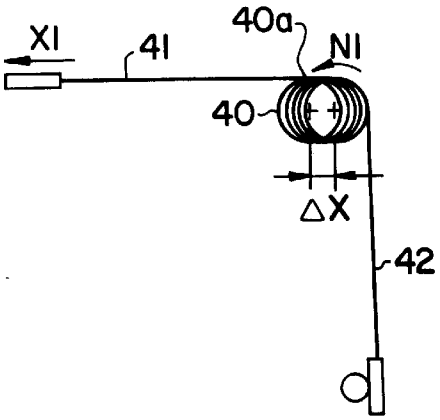
Figure 11D:
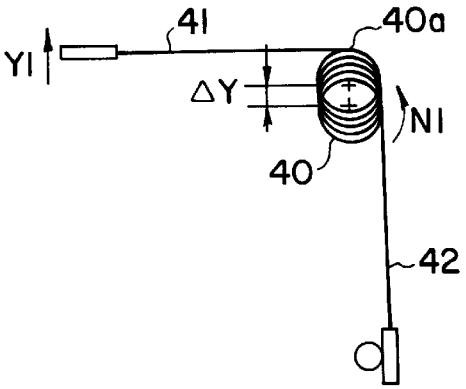
Figure 11C:
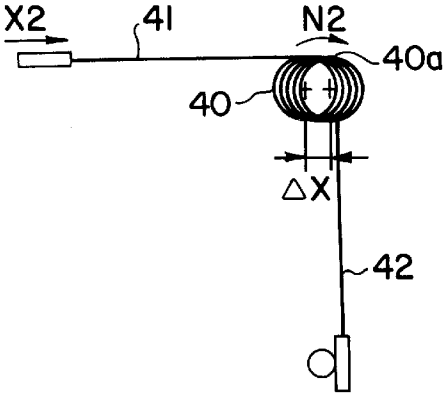
Figure 11E:
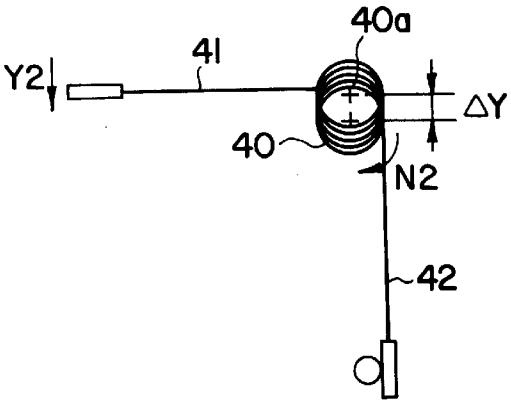

FIG. 10 is a view along arrow 10 in FIG. 9, showing a plan view of the coil part 40. Since the coil part 40 appears circular in the plan view, the circle traced by the center of wire-shaped conductor 38 is referred to as coil circle 43.

One leg 41 is a member that extends out in a straight line from one coiled end part 40*a* of the coil part 40 at a tangent to the coil circle 43, and the other leg 42 is a member that extends out in a straight line from the other coiled end part 40*b* of coil part 40 at a tangent to the coil circle 43 and at right angles to one leg 41. One leg 41 and the other leg 42 are mutually perpendicular. Therefore when vibration occurs in one leg 41 and/or the other leg 42, the vibration is absorbed by causing twisting in the coil part 40.

FIGS. 11(*a*) through (*e*) are illustrations explaining the operation of an automobile light bulb according to a fourth embodiment of the present invention, which is a theoretical view for confirming the operation of the dipped beam filament 37.

FIG. 11(*a*) illustrates the vibration direction X1, X2, Y1 and Y2 of shield 36. When the automobile light bulb 1C vibrates, lead 7 for the dipped beam filament also vibrates along with shield 36, but since the vibration amplitude of the lead 7 is small compared with that of shield 36, only the vibration of shield 36 will be described.

FIG. 11(*b*) illustrates how, when the shield 36 vibrates in direction X1, one leg 41 vibrates with amplitude $\Delta X$ in direction X1. As a result, the vibration is absorbed by the side of one coiled end 40*a* of coil part 40 twisting in the direction of arrow N1.

FIG. 11(*c*) illustrates how, when the shield 36 vibrates in direction X2, one leg 41 vibrates with amplitude $\Delta X$ in direction X2. As a result, the vibration is absorbed by the side of one coiled end 40*a* of coil part 40 twisting in the direction of arrow N2.

FIG. 11(*d*) illustrates how, when the shield 36 vibrates in direction Y1, one leg 41 vibrates with amplitude $\Delta Y$ in direction Y1. As a result, the vibration is absorbed by the side of one coiled end 40*a* of coil part 40 twisting in the direction of arrow N1.

FIG. 11(*e*) illustrates how, when the shield 36 vibrates in direction Y2, one leg 41 vibrates with amplitude $\Delta Y$ in direction Y2. As a result, the vibration is absorbed by the side of one coiled end 40*a* of coil part 40 twisting in the direction of arrow N2.

Figure 12:
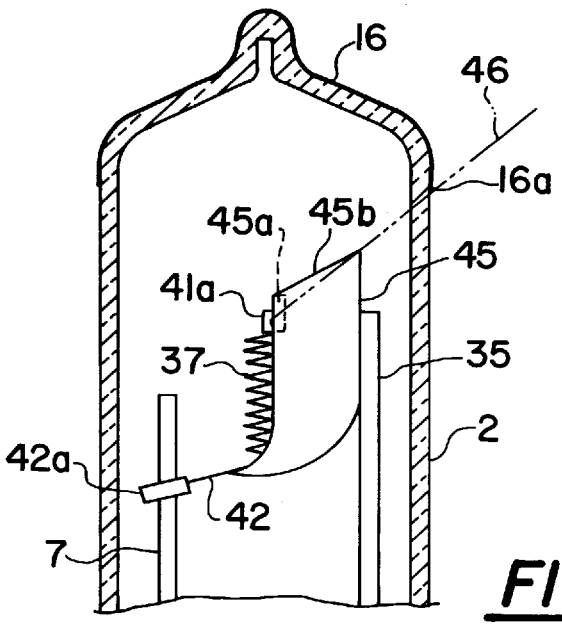
FIG. 12 is a side view of the salient parts of an automobile light bulb according to a fifth embodiment of the present invention.

FIG. 12 is a side view of the salient parts of an automobile light bulb according to a fifth embodiment of the present invention, showing the relative positions of the glass bulb 2, common lead 35, shield 45, dipped beam filament 37, lead 7, and lightshielding film 16.

As in the fourth embodiment, the dipped beam filament 37 has the tip 41*a* of one leg 41 fixed to the tongue part 45*a* of shield 45, and has the tip 42*a* of the other leg 42 fixed to the lead 7 for the dipped beam filament.

Shield 45 is a member having a half-cup shape like shield 36 of the fourth embodiment but with the top part cut away, the tip of the cutaway part 45*b* extends up to a straight line 46 joining dipped beam filament 37 to the tip part 16*a* of light-shielding film 16. This is because direct rays of light emitted from dipped beam filament 37 are shielded by shield 45.

Since shield 45 can be made lighter, the vibration of shield 45 can be made smaller. Accordingly, the life of dipped beam filament 37 can be further prolonged.

Figure 13:
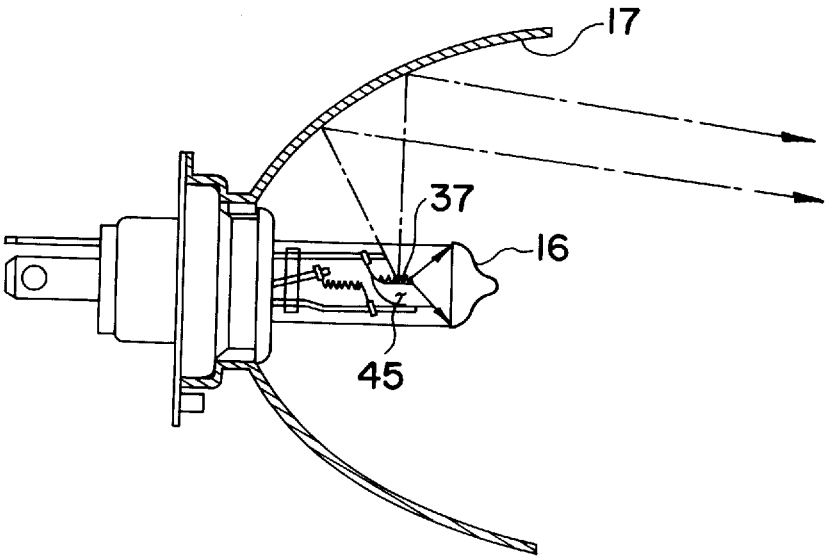
FIG. 13 is an illustration explaining the operation of an automobile light bulb of the fifth embodiment of the present invention.

FIG. 13 is an illustration explaining the operation of an automobile light bulb according to a fifth embodiment of the present invention, which is a theoretical view for confirming the operation of shield 45 with the top part, as illustrated to the right in FIG. 13, being cut away.

Rays of light emitted directly from the dipped beam filament 37 are blocked by shield 45 to prevent them from reaching down to the bottom of FIG. 13, but proceed to the top of FIG. 13 where they are reflected by a parabolic mirror 17 and then proceed in the direction of the arrows. Accordingly, the operation of the shield 45 is in no way inferior to that of the full-cup shield 36 described in, for example, the fourth embodiment, even though it is a half-cup with the top part cut away.

Figure 14:
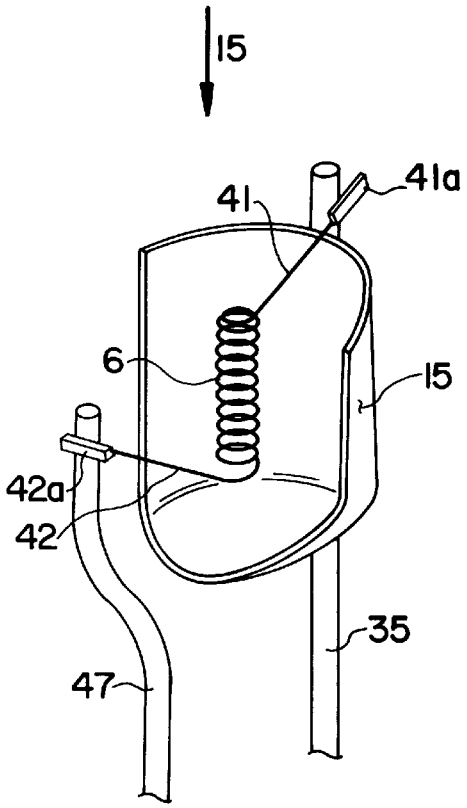
FIG. 14 is an oblique view showing the salient parts of an automobile light bulb according to a sixth embodiment of the present invention.

FIG. 14 is an oblique view showing the salient parts of an automobile light bulb according to a sixth embodiment of the present invention. The sixth embodiment is characterized in that the tip 41*a* of one leg 41 of dipped beam filament 37 is fixed to a common lead 35, and in that the tip 42*a* of the other leg 42 is fixed to lead 47 for the dipped beam filament.

Shield 15 is a half cup with the top part cut away, which is identical to the member in the second embodiment. Lead 47 for the dipped beam filament is a member with a tip part which is curved along the left side of shield 15.

Figure 15:
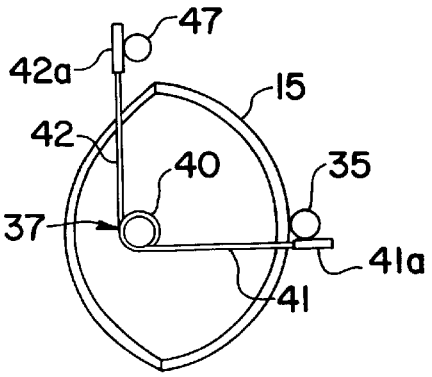
FIG. 15 is a view taken along arrow 15 in FIG. 14.

FIG. 15 is a view taken along arrow 15 in FIG. 14, showing how the tip 41*a* of one leg 41 is fixed to a common lead 35 and the tip 42*a* of the other leg 42 is fixed to lead 47 for the dipped beam filament.

Since the one leg 41 and the other leg 42 of the dipped beam filament 37 are also arranged at right angles in this embodiment, it is possible to absorb vibration with the coil part 40 in the same way as in the fourth embodiment.

Figure 16:
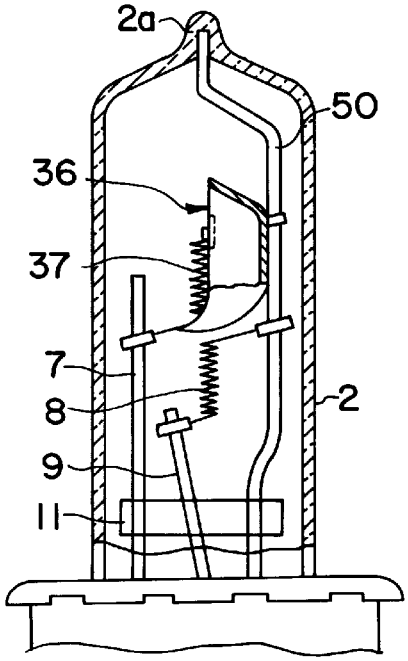
FIG. 16 is an oblique view showing the salient parts of an automobile light bulb according to a seventh embodiment of the present invention.
Figure 19:
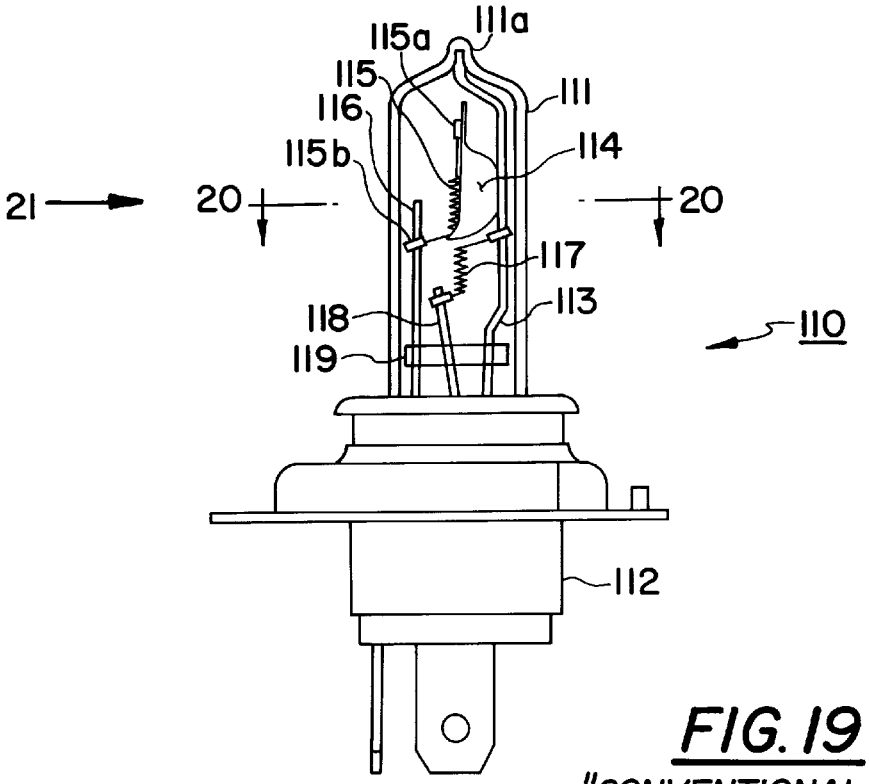
FIG. 19 is a side view of a conventional vibration resistant automobile light bulb.
Figure 20:
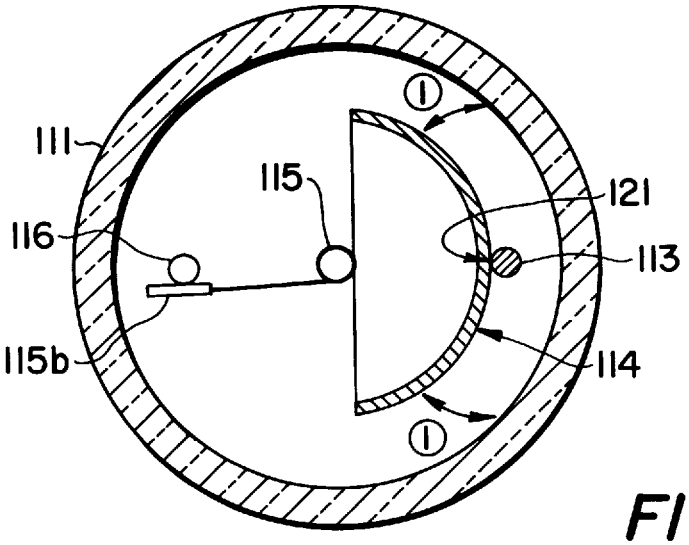
FIG. 20 is a cross-sectional view taken along line 20—20 in FIG. 19.
Figure 21:
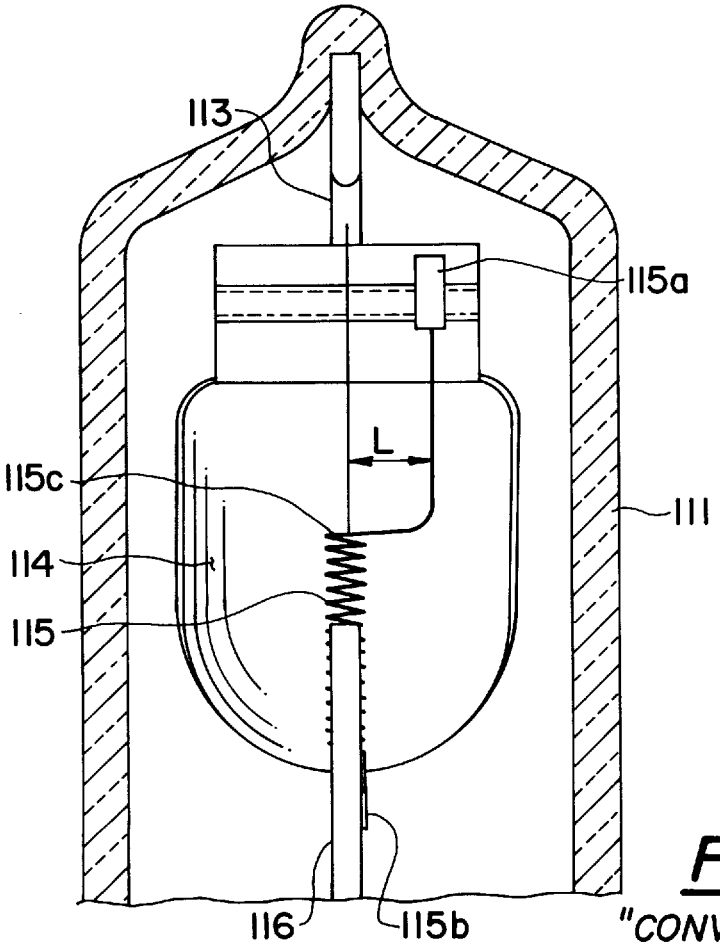
FIG. 21 is a view taken along arrow 21 in FIG. 19.

FIG. 16 is an oblique view showing the salient parts of an automobile light bulb according to a seventh embodiment of the present invention, this embodiment includes a common lead 50 which is a beam supported at both ends by extending the tip part of the common lead 50 up to the neck part 2*a* of glass bulb 2 in the same way as the vibration-resistant light bulb of FIG. 19. By making the common lead 50 a beam that is supported at both ends, shield 36 vibrates clockwise and counterclockwise centered on common lead 50.

Figure 17A:
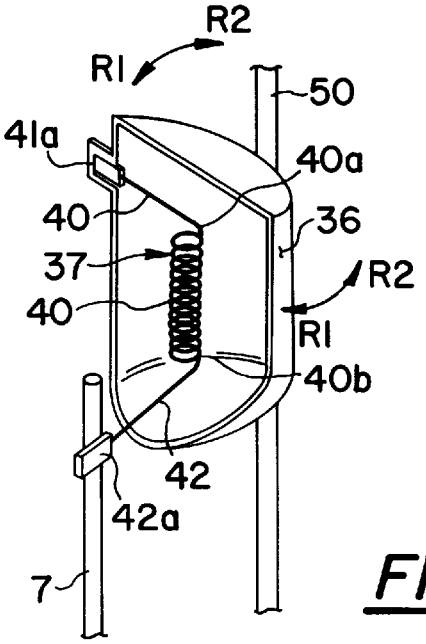
FIG. 17(*a*) is an illustration explaining the operation of an automobile light bulb according to the seventh embodiment of the present invention.
Figure 17B:
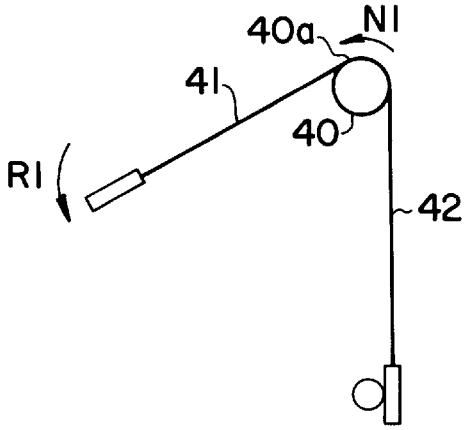
Figure 17C:
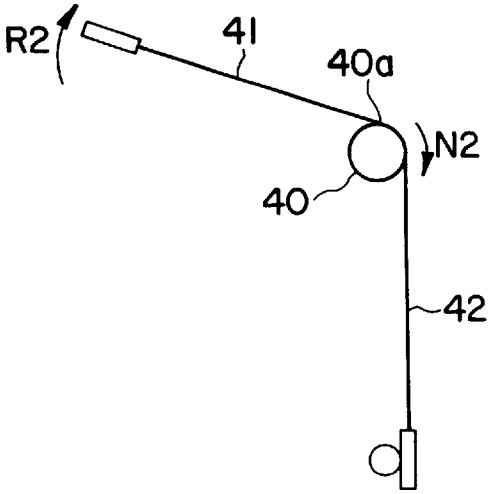

FIGS. 17(*a*) through (*c*) are illustrations explaining the operation of an automobile light bulb according to a seventh embodiment of the present invention, which are theoretical views for confirming the operation of vibration absorption by dipped beam filament 37.

FIG. 17(*a*) illustrates the vibration directions R1 and R2 of shield 36.

FIG. 17(*b*) illustrates how one leg 41 vibrates in the direction of arrow R1 when shield 36 vibrates in the direction R1. As a result, the aide of one coiled end part 40*a* of coil part 40 absorbs the vibration by twisting in the direction of arrow N1.

FIG. 17(*c*) illustrates how one leg 41 vibrates in the direction of arrow R2 when shield 36 vibrates in direction R2. As a result, the side of one coiled end part 40*a* of coil part 40 absorbs the vibration by twisting in the direction of arrow N2.

Note that although the present invention according to a first through third embodiments may be effectively applied to vibration resistant light bulbs wherein the tip of the common lead 4 is secured to the glass bulb 2, see FIG. 19, it can also be applied to ordinary light bulbs, see FIG. 18.

Also, the leg 6*a* of the dipped beam filament 6 may be directly guided to the common lead, and the shape of the shield 5, the size and shape of any hole formed therein, and the shape of the cutaway portion if the top portion is cut away, may all be set as desired.

Although automobile light bulbs have been described in the first through the seventh embodiments above, the automobile light bulbs can naturally be applied not just to automobiles but also to vehicles such as motorcycles and electric trains.

The present invention exhibits the following advantages with regard to one leg of the dipped beam filament is fixed directly to the common lead. Since one leg of the dipped beam filament is fixed directly to the common lead, which is not liable to vibrate, instead of to the shield which is likely to vibrate, vibration of the dipped beam filament can be suppressed and the life of the vehicle bulb can be further prolonged.

In addition, a hole may be formed in the shield and one leg of the dipped beam filament may be guided to the common lead by passing the filament through this hole. Since this only involves forming a hole in a shield that is currently available, this feature of the present invention would be relatively inexpensive.

A light-shielding film may be applied to the tip of the glass bulb, the shield is cut away at the portion shielded by the shielding film, and one leg of the dipped beam filament is guided to said common lead through this cutaway portion.

This provides for a shield that is reduced in size by making skillful use of a light-shielding film, whereby it is possible both to economize on the materials used for the shield and to prolong the life of the vehicle light bulb.

The shield may include a cup part and a tongue part that are fixed and extend from the cup so as to pass through roughly the center of the bulb. The tongue part may be fixed to one leg of the dipped beam filament at roughly the central position of the glass bulb. When the shield vibrates, since one leg of the dipped beam filament is fixed at the center of swaying, the vibration amplitude of the dipped beam filament can be suppressed and the life of the vehicle light bulb can be further prolonged.

The dipped beam filament includes a coil part having a conductor formed in the shape of a coil spring, one leg extends out in a straight line from one end of the coil part along a line that is tangential to the coils of this coil part, and another leg extends out in a straight line from the other end of the coil part along a line that is tangential to the coils of this coil part and is perpendicular to this one leg. The one leg is fixed to the shield and the other leg is fixed to the dipped beam filament lead.

Even if one leg vibrates due to a vibration of the shield, this vibration can be absorbed by the coil part so that the life of the vehicle light bulb can be further prolonged.

The shield is provided with a tongue part for fixing the other leg. Since the tongue part is provided, it is easy to fix the other leg of the dipped beam filament to the shield.

The dipped beam filament consists of a coil part including a conductor formed in the shape of a coil spring, one leg that extends out in a straight line from one end of the coil part along a line that is tangential to the coils of this coil part, and another leg that extends out in a straight line from the other end of the coil part along a line that is tangential to the coils of this coil part and is perpendicular to this one leg. The one leg is fixed to the common lead and the other leg is fixed to the dipped beam filament lead.

Even if the one leg vibrates due to vibration of the common lead, this vibration can be absorbed by the coil part and the life of the vehicle light bulb can be further prolonged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle light bulb comprising:

a common lead;

a dipped beam filament operatively connected to a first lead;

a main beam filament operatively connected to a second lead;

a glass bulb for accommodating said common lead, said dipped beam filament and said main beam filament;

a shield fixed to said common lead at a position adjacent the dipped beam filament; and one leg of said dipped beam filament being fixed directly to the common lead.

2. The vehicle light bulb according to claim 1, wherein a hole is formed in said shield and said one leg of the dipped beam filament is guided to the common lead by passing it through the hole.

3. The vehicle light bulb according to claim 1, wherein a light-shielding film is applied to a tip of said glass bulb, the shield is cut away at a portion shielded by the shielding film, and said one leg of the dipped beam filament is guided to said common lead through this cutaway portion.

4. A vehicle light bulb comprising:

a common lead;

a dipped beam filament operatively connected to a first lead;

a main beam filament operatively connected to a second lead;

a glass bulb for accommodating said common lead, said dipped beam filament and said main beam filament;

a shield being fixed to said common lead at a position adjacent the dipped beam filament, said shield including a cup part and a tongue part, said tongue part being fixed and extending from said cup part so as to pass generally through a center of the bulb, and said tongue part being fixed to said one leg of the dipped beam filament generally at the center of the glass bulb.

5. The vehicle light bulb according to claim 4, wherein the tongue part of the shield extends from a side of the cup part opposite the common lead, away from where the shield is fixed to the common lead, to pass generally through the center of the bulb.

6. The vehicle light bulb according to claim 4, wherein a bottom, closed portion of the cup part is fixed to the common lead and the tongue part extends from a top, open portion of the cup part, away from where the shield is fixed to the common led, to pass generally through the center of the bulb.

7. A vehicle light bulb comprising:

a common lead;

a dipped beam filament operatively connected to a first lead;

a main beam filament operatively connected to a second lead;

a glass bulb for accommodating said common lead, said dipped beam filament and said main beam filament;

a shield fixed to said common lead at a position adjacent the dipped beam filament;

said dipped beam filament includes a coil part having a conductor formed in a shape of a coil spring, a first leg extends out in a straight line from one end of the coil part along a line that is tangential to the coils of the coil part, and a second leg extends out in a straight line from the other end of the coil part along a line that is tangential to the coils of this coil part and is perpendicular to the first leg, said first leg is fixed to said shield and the second leg is fixed to the first lead.

8. The vehicle light bulb according to claim 7, wherein said shield is provided with a tongue part for fixing the first leg.

9. A vehicle light bulb comprising:

a common lead, a dipped beam filament operatively connected to a first lead;

a main beam filament operatively connected to a second led;

a glass bulb for accommodating said common lead, said dipped beam filament and said main beam filament;

a shield fixed to said common lead at a position adjacent the dipped beam filament;

said dipped beam filament includes a coil part having a conductor formed in a shape of a coil spring, a first leg extends out in a straight line from one end of the coil part along a line that is tangential to the coils of the coil part, and a second leg extends out in a straight line from the other end of the coil part along a line that is tangential to the coils of this coil part and is perpendicular to this one leg, and in that the first leg is fixed to said common lead and the second leg is fixed to the first lead.

10. The vehicle light bulb according to claim 9, wherein the shield is cut away at one portion thereof and said one leg of the dipped beam filament is guided to said common lead through this cutaway portion.

* * * * *